US006586664B1

(12) United States Patent
Hubbell

(10) Patent No.: US 6,586,664 B1
(45) Date of Patent: Jul. 1, 2003

(54) DRUM MUTING SYSTEM

(76) Inventor: Francis Park Hubbell, 11521 SW. 109$^{th}$ Rd., #C, Miami, FL (US) 33176

( * ) Notice: Subject to any disclaimer, the term of this patent is extended or adjusted under 35 U.S.C. 154(b) by 0 days.

(21) Appl. No.: 09/888,356

(22) Filed: Jun. 25, 2001

(51) Int. Cl.$^{7}$ ..... G10D 13/08
(52) U.S. Cl. ..... 84/411 M; 84/411 P
(58) Field of Search ..... 84/411 A, 411 M, 84/411 P

(56) References Cited

U.S. PATENT DOCUMENTS 4,154,137 A * 5/1979 Kobayashi ..... 84/411 R
4,745,839 A * 5/1988 Peraino ..... 84/411 M
4,899,635 A * 2/1990 Santangelo ..... 84/411 M
5,581,030 A * 12/1996 Conroy ..... 84/411 M
5,892,169 A * 4/1999 Shapiro ..... 84/411 M

* cited by examiner

*Primary Examiner*—Kim Lockett
(74) *Attorney, Agent, or Firm*—Malloy & Malloy, P.A.

(57) ABSTRACT

A drum muting system is provided to be removably mounted on a drum which muffles the natural sound produced by the drum, thereby allowing the tone of the drum to be controlled. The drum muting system includes an outer frame, a muting element, an inner muting assembly, a drum mounting structure, and an adjustment mechanism. The outer frame supportably engages the inner muting assembly which includes the muting element and a muting element support member. The inner muting assembly is maintained in an operative position relative to the outer frame by a suspension assembly which includes at least one but preferably a plurality of biasing elements secured to the outer frame and inner muting assembly by biasing element anchors. The adjustment mechanism permits the muting element to be selectively positioned relative to the outer surface of the drum head to permit an increase or decrease in the muting effect achieved.

45 Claims, 3 Drawing Sheets

DRUM MUTING SYSTEM

BACKGROUND OF THE INVENTION

1. Field of the Invention

This invention is directed to a drum muting system which is mounted directly to a drum such that a muting element is maintained in direct contact with the outer surface of the drum head. The drum muting system provides a variable degree of muting which is obtained by selectively positioning the muting element relative to the outer surface of the drum head. The drum muting element muffles the natural sound produced by a drum when it is struck, thereby allowing the tone produced by the drum to be controlled.

2. Description of the Related Art

A standard drum set typically includes at least one bass drum. The bass drum is usually the largest drum in the set and also the drum producing the lowest pitched sound, thus its name. Other drums normally present in a standard drum set include a snare drum, and an assortment of tom tom drums which may either be mounted above the bass drum, or floor mounted adjacent the other drums. With the exception of the snare drum, the basic difference between these various drums is the diameter and length of their bodies.

Typically, bass drums have a drum head covering each open end of the drum body. Each head is attached by a hoop or rim which secures the drum head to the body. The rim typically includes a variety of 'tuning keys' which allow a drummer to adjust how tightly the drum head is stretched across the open end of the drum to adjust the pitch produced by the drum when it is struck. The rear head of a bass drum is typically struck with a mallet-like assembly attached to a foot pedal, which causes the front head to vibrate, thus producing the sound that is heard.

Often times, however, a drummer may desire to alter other acoustic characteristics of a particular drum, perhaps due to the acoustics of the performance hall or recording studio, to compensate for the type of drum, or to achieve a unique tone. One common alteration is the reduction in both the amplitude and duration of the vibration of the front head of a bass drum in attempts to eliminate the 'boominess' normally associated with such drums, also known as dampening or muting. The dampening or muting of a drum effectively muffles the natural sound produced by the drum, thereby allowing the tone to be controlled. In some cases, it may be desirable to mute one or more of the tom toms as well.

There are several devices which have been employed in an attempt to mute a standard bass drum. One of the earliest being any one of a number of light weight materials which are placed directly inside the bass drum. The materials utilized for this purpose typically contain a significant amount of air in the interstitial spaces, such as pillows, loosely placed towels, foam rubber, and even thermal insulation material. While the placement of these materials inside of the body of the drum mute the sound to an extent, there is also a subsequent reduction in the quality of the acoustics of the drum as a result of the placement of foreign materials inside the body. Each drum is acoustically designed based on a specific diameter and height combination, which necessarily correspond to a specific internal to volume, and the placement of foreign material inside of the drum alters the internal volume, thus altering the internal acoustic characteristics of the drum, typically, in a negative manner.

In an attempt to avoid the pitfalls encountered by placing foreign material inside the body of a drum, several devices have been developed which are designed to be attached to the inner surface of the drum head to mute the drum. One device used for this purpose includes one or more flat strips of felt-like material, usually several inches wide, stretched taunt across one or, both heads of the drum. The material is usually stretched across the entire diameter of the drum head, however, placement of the material across less than the entire diameter is used to provide a lesser degree of dampening or muting. However, this device does not permit easy adjustment of the degree of muting over a continuous range. This is because both the amount of material placed over the drum head and the area of the drum head covered must be adjusted to change the degree of muting, and the amount of material is dependent on the width, thickness, and pieces of material used. In addition, this device requires at least partial removal and replacement of the drum head or heads, and it is, therefore, time consuming to make an adjustment. Because of all of the various factors that effect the degree of muting achieved, extensive trial and error may be required to arrive at the desired effect, which as noted above, may be very time consuming.

To provide more versatility in the adjustment of the muting effect, devices have been, once again, placed inside the body of the drum which include a muting element in contact with the inside of the drum head. However, as noted above, the placement of foreign material inside the body of the drum affects the internal acoustic characteristics of the drum, and is not generally desired. More significantly, placement of the device against the inside surface of the drum head permits the disassociation of the muting element from the drum head as it vibrates outward and away from the device. Thus, an inconsistent and perhaps intermittent degree of muting results depending on whether the drum is struck with greater or lesser force.

Therefore, a clear need exists for a drum muting system that is externally mounted so as not to interfere with the internal acoustic characteristics of a drum.

Additionally, a need exists for a drum muting system which provides a simple and easy means for adjusting the degree of muting over a continuous range.

There is further a need for a drum muting system that provides a consistent degree of muting regardless of the amount of force with which the drum is struck.

SUMMARY OF THE INVENTION

The present invention is directed to a drum muting system mounted on the outside of a standard drum which permits a drummer to adjust the degree of muting of the bass or other drum. Muting a drum effectively muffles the natural sound produced by the drum when it is struck, therefore, muting allows the tone of the drum to be variably controlled. In particular, the drum muting system includes a muting assembly having a muting element structured to alter the natural sound produced by the drum. The muting assembly includes an outer frame which supportably engages an inner muting assembly. The inner muting assembly includes a muting element. The inner muting assembly may also include a muting element frame and/or a support member. A drum mounting structure is provided to removably mount the system to most standard drums.

The muting assembly further includes a suspension assembly having at least one but preferably a plurality of biasing elements. The suspension assembly is structured and disposed to maintain the inner muting assembly in an operative position relative to the outer frame. The suspension assembly is further disposed to attenuate the movement of the inner muting assembly, which also results in the attenuation of movement of the drum head when the muting element is in operative engagement with the drum. The operative engagement of the muting element is defined when the muting element is oriented and maintained in substantially direct contact with the outer surface of the drum head as the drum head vibrates, such that the muting element is essentially tracking the oscillation of the drum head. Therefore, when the muting element is in operative engagement, it will at least partially absorb the vibration from the drum head when the drum is struck. Thus, vibrational energy is initially transferred from the drum head to the muting element from which it is transferred to and attenuated by the biasing elements of the suspension mechanism.

The present invention also includes an adjustment mechanism structured to adjust the effect of the muting assembly on the drum. As noted above, the muting element is structured to be in substantially direct contact with the outer surface of the drum head when oriented in operative engagement. The adjustment mechanism is utilized to force the muting element into operative engagement with the drum head and maintain it in operative engagement while the drum head vibrates. The greater the force applied to hold the muting element in operative engagement, the greater the muting effect observed, while the application of less force results in less of a muting effect. Thus, by permitting control over the amount of force applied to the muting element to maintain it in operative engagement with the drum head, the adjustment mechanism allows the degree of muting to be controlled.

Accordingly, the present invention is directed to a drum muting system which is completely externally mounted so as not to interfere with the internal acoustic characteristics of the drum. Further, the present invention includes an adjustment assembly which allows the degree of muting to be simply and easily adjusted over a continuous range. Additionally, the adjustment assembly of the present invention in combination with the suspension assembly provides for a consistent and continuous degree of muting regardless of the amount of force with which the drum is struck by maintaining the muting element in substantially direct contact with the outer surface of the drum head as the vibration is attenuated.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
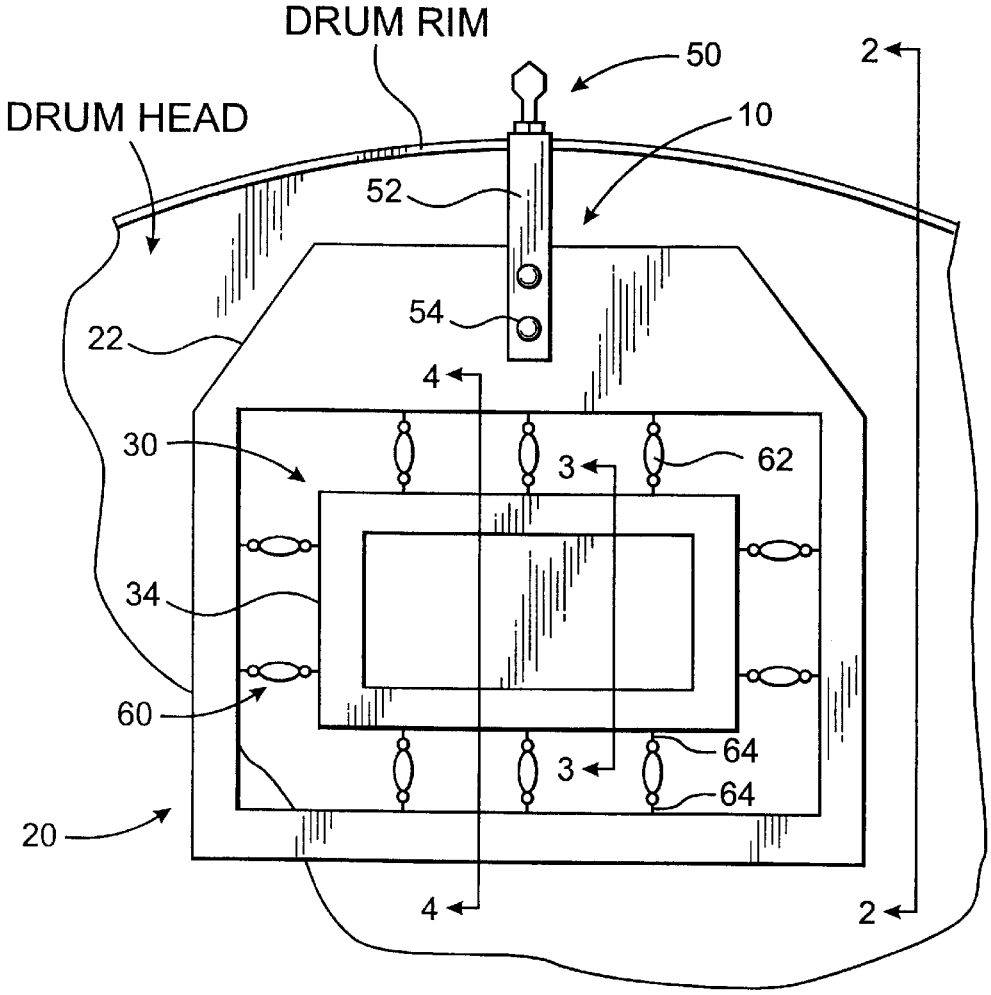
FIG. 1 is a rear elevation of one preferred embodiment of the present invention.
Figure 2:
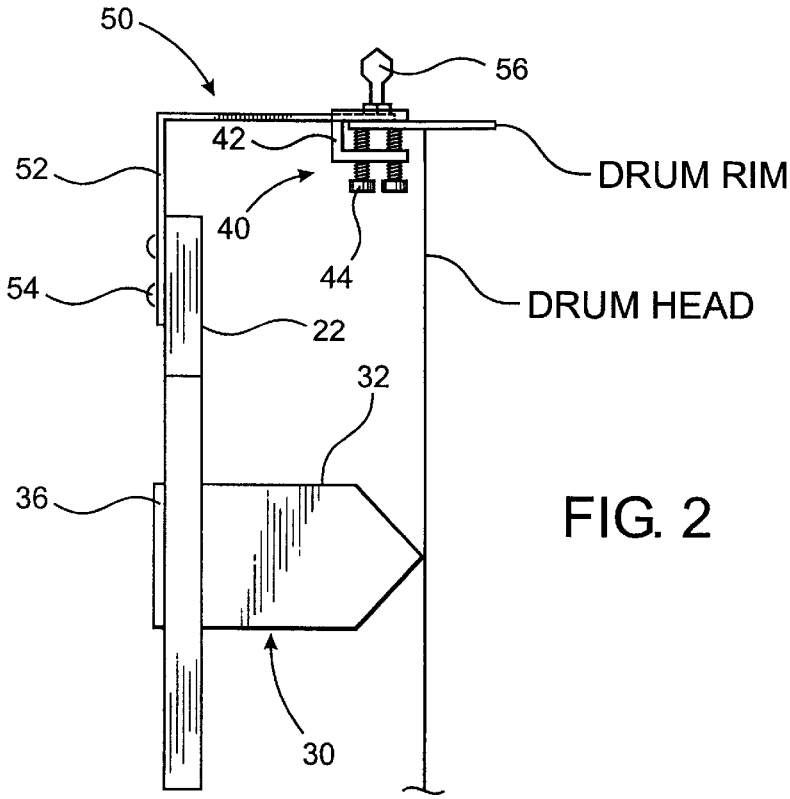
FIG. 2 is a side elevation of the embodiment of FIG. 1 along 2—2 thereof, oriented for minimal muting effect.

With reference now to the accompanying Figures, the present invention is directed to a drum muting system 10 for a drum as generally illustrated in FIG. 1. The drum muting system 10 includes a muting assembly 20 having an inner muting assembly 30, as generally shown in FIG. 1. Additionally, the drum muting system 10 includes a drum mounting structure 40 and an adjustment mechanism 50, as generally illustrated in FIG. 2. In a preferred embodiment of the present invention, each of these components are externally mounted to a rim of a drum.

Figure 3:
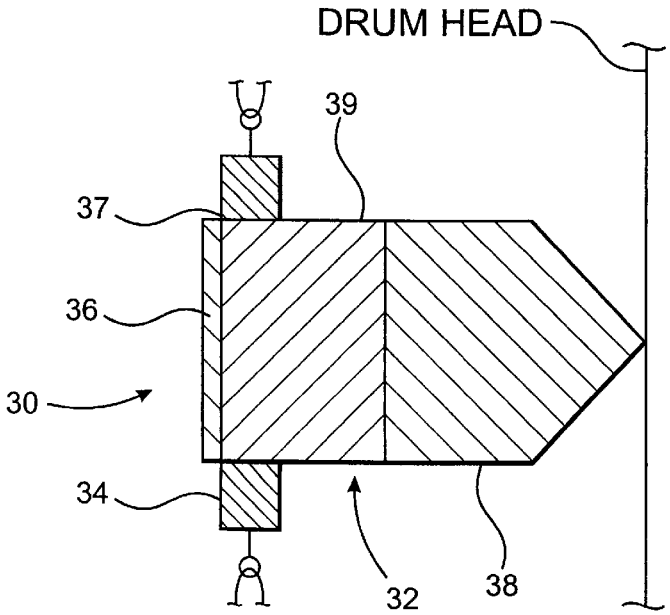
FIG. 3 is a cross sectional elevation of the embodiment of FIG. 1 along 3—3 thereof.

Looking to the muting assembly 20 it includes the inner muting assembly 30 supportably engaged by an outer frame 22. The inner muting assembly 30 further comprises at least a muting element 32. The muting element 32 may be constructed of a homogenous resilient material, or it may include both a muting portion 38 and a base portion 39, as illustrated in FIG. 3. In a preferred embodiment of the present invention, the muting portion 38 is comprised of highly resilient latex foam rubber, although other materials including, but not limited to, other types of resilient synthetic foam, felt like materials, etc. may also be utilized. In embodiments including a base portion 39, it is constructed from material which is less resilient than the muting portion 38, such that the muting portion 38 gives or compresses under pressure before the base portion 39. By way of example only, the base portion 39 may be comprised of denser foam rubber, natural rubber, pliable plastic, etc.

Further, in a preferred embodiment, the inner muting assembly 30 includes a support member 36 as illustrated in FIGS. 2 and 3. The support member 36 is preferably composed of substantially rigid material, for example, plastic, metal, wood, or other material of sufficient rigidity so as to maintain the interface 37 of the support member 36 and the muting element 32 in a substantially planar orientation. However, an alternate embodiment of the present invention may include a support member 36 composed of a flexible material, and another alternate embodiment includes no support member. In the preferred embodiment, the support member 36 essentially prevents the muting element 32 from being displaced, rather than compressed, when the muting element 32 is in operative engagement with the drum head as discussed below. The support member 36 is preferably sized so as to at least substantially cover the surface of the muting element 32 directly opposite the surface which contacts the drum head, as shown in FIGS. 2 and 3.

Figure 4:
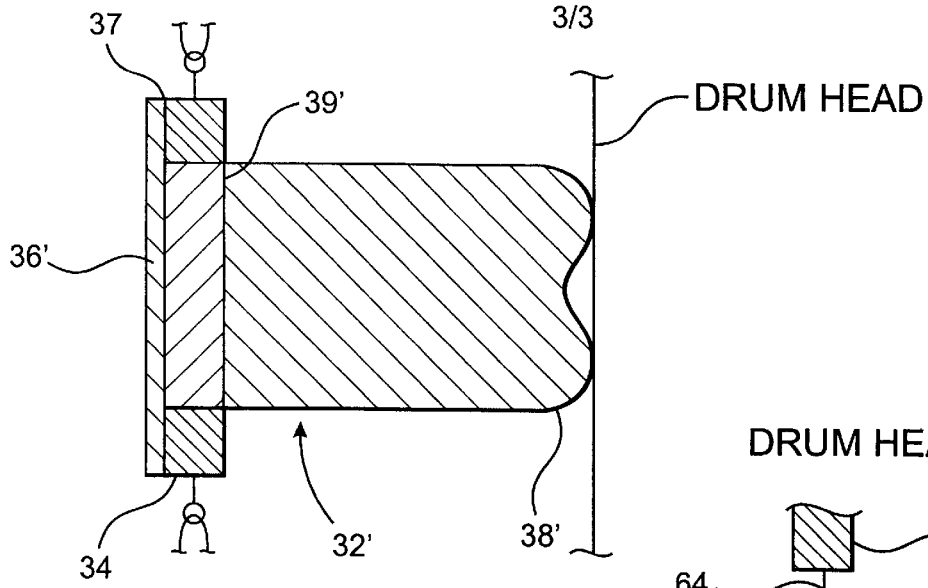
FIG. 4 is a cross-sectional elevation of another embodiment of the present invention illustrating an alternate configuration of the muting element.

In one embodiment, the inner muting assembly 30 includes a muting element frame 34, onto which the muting element 32, or base portion 39 thereof, is mounted. The muting element frame 34 is constructed of a rigid material, including but not limited to, for example, plastic, metal, wood, or other material of sufficient rigidity. FIG. 4 illustrates an alternative embodiment of support member 36', in which the support member 36' is sized so as to substantially cover the surface of the muting element frame 34 opposite the surface facing the drum head. This embodiment provides additional support for the muting element 32' by affixing the support member 36' to the rear of the muting element frame 34, by any standard mechanical fastening means such as screws, bolts, rivets, welds, solder, adhesive, etc. The embodiment of FIG. 4 also illustrates an alternate form of the muting element 32' which comprises a dual rounded peak configuration and includes a muting portion 38' and a base portion 39'. This configuration of the muting element 32', as well as the single triangular peak configuration as shown in FIGS. 2 and 3, are presented by way of example only, as there are numerous geometric configurations which may be utilized in the present invention to define the surface of the muting element 32 which contacts the drum head, including a plurality of rounded or triangular peaks, diagonally oriented peaks, crisscrossing peak patterns, or a planar surface, just to name a few. In-an alternate embodiment of the present invention, the muting element 32 may include one or more apertures formed between the surface which contacts the drum head and the opposing surface.

Figure 5:
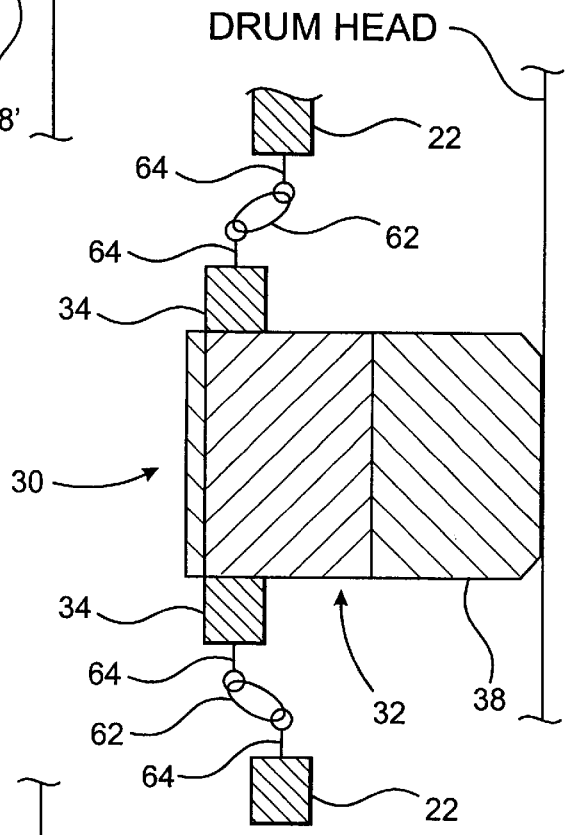
FIG. 5 is a cross sectional elevation of the embodiment of FIG. 1 along 4—4 thereof, illustrating the muting element in operative engagement with the drum head.
Figure 6:
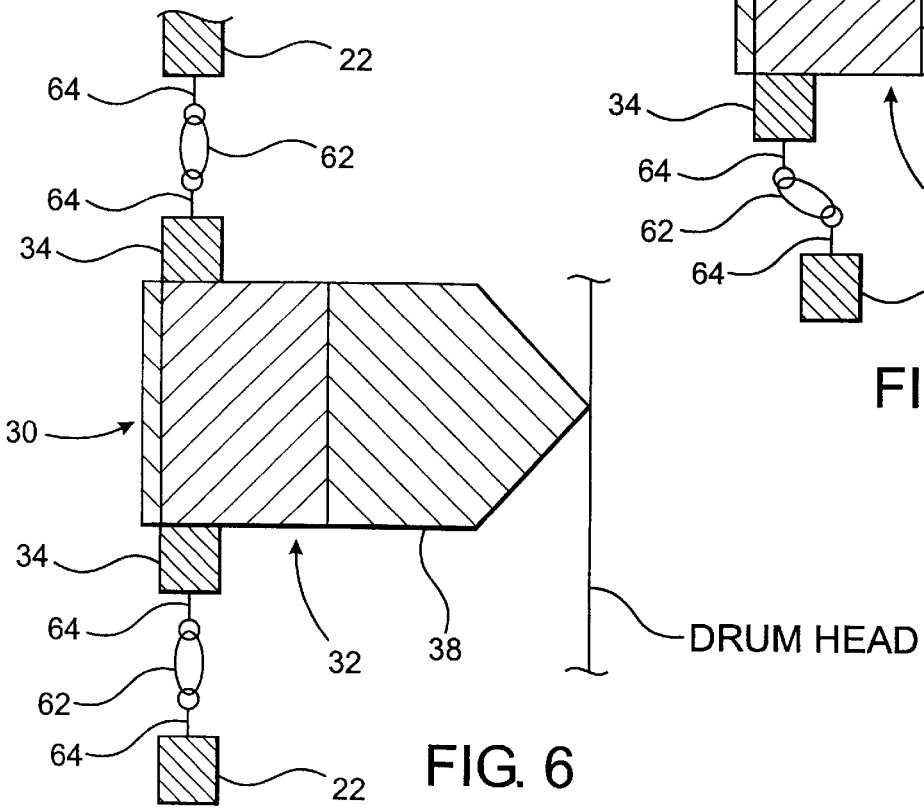
FIG. 6 is a cross sectional elevation of the embodiment of FIG. 1 along 4—4 thereof, illustrating the inner muting assembly in an unstressed operative position.

As previously noted, the inner muting assembly 30 is supportably engaged by the outer frame 22. The present invention further includes a suspension assembly, generally shown as 60 in FIG. 1, which provides the means for the inner muting assembly 30 to be supportably engaged. The suspension assembly 60 comprises at least one, but preferably a plurality of biasing elements 62. The biasing elements 62 may include any of the elements known in the art including elastic bands, elastomeric chords, springs, and/or other material which will allow the displacement of the inner muting assembly 30 as illustrated in FIG. 5 when the muting element 32 is oriented in operative engagement with the drum. Additionally, the suspension assembly 60 must be capable of returning the inner muting assembly 30 to an unstressed operative position relative to the outer frame 22, as illustrated in FIG. 6.

Each biasing element 62 is attached at opposing ends to each one of a corresponding pair of biasing element anchors 64. Each pair of anchors 64 includes both a first anchor and a second anchor, wherein each first and second anchor is secured to a different one of the outer frame 22 and the inner muting assembly 30. In a preferred embodiment, as illustrated in FIGS. 1, 3, 4, 5 and 6, at least one of each pair of biasing anchors 64 is secured directly to the muting element frame 34. However, the biasing anchors 64 may alternatively be attached directly to the support member 36 or muting element 32.

In addition to providing support for the inner muting assembly 30, the suspension assembly 60 attenuates the vibrational energy transferred from the drum head to the muting element 32, when the muting element 32 is oriented in operative engagement with the drum head. The operative engagement of the muting element 32 with the drum head is defined when the muting element 32 is positioned and maintained in substantially direct contact with the outer surface of the drum head as the drum head vibrates, such that the muting element 32 is essentially tracking the oscillation of the drum head. Additionally, the substantially direct contact is maintained independent of the amplitude of the vibration of the drum head, which varies with the amount of force with which the drum is struck. When in operative engagement, the muting element 32 will at least partially absorb vibrational energy from the drum head, which is then transferred from the inner muting assembly 30 to the suspension assembly 60, where it is attenuated. The attenuation of the vibrational energy from the drum head occurs while the muting element 32 is maintained in substantially direct contact with the drum head. The attenuation by the suspension assembly 60 results in the attenuation of the vibrational movement of the inner muting assembly 30, to which the muting element 32 is mounted, and as a result of the substantially direct contact between the muting element 32 and the drum head, the vibration is of the drum head is also attenuated, thereby producing the desired muting effect.

The suspension assembly 60 is structured such that greater force is required to displace the biasing elements 62 from their unstressed operative position, than is required to compress the muting element 32. As a result, only a relatively small force is required to maintain the muting element 32 in substantially direct contact with the outer drum head. As the drum is struck, the outer surface of the drum head vibrates outwardly and the additional force further compresses the muting element 32, while the suspension assembly 60 retains the inner muting assembly 30 in substantially the same position relative to the outer frame 22.

The drum muting system 10 further includes a drum mounting structure 40 having a drum mounting bracket 42 and at least one drum mounting fastener 44, which in a preferred embodiment is a threaded bolt which engages a threaded aperture through the drum mounting bracket 42. The drum mounting bracket 42 is structured to include a generally U-shaped channel which will fit over the outer rim of most standard drums, as illustrated in FIG. 2. After the drum mounting bracket 42 is positioned over the outer rim of the drum, the drum mounting fastener 44 is tightened down until the outer rim is secured between the drum mounting bracket 42 and the drum mounting fastener 44.

The present invention also includes an adjustment mechanism 50, as illustrated in FIGS. 1 and 2. The adjustment mechanism 50 includes an adjustment bracket 52 and an adjustment key 56. The adjustment bracket 52 is secured to the outer frame 22 by at least one adjustment mechanism fastener 54 which may include screws, bolts, rivets, etc. In an alternate embodiment, the adjustment mechanism bracket 52 may be secured to the outer frame 22 by adhesive, solder or weld, or it may be fabricated as an integral component of the outer frame 22.

The adjustment mechanism bracket 52 is structured to slidingly engage the drum mounting bracket 42, as illustrated in FIG. 2. The adjustment bracket 52 may be quickly, easily and selectively positioned, thus selectively positioning the muting element 32, by sliding the adjustment bracket 52 along a guide channel secured to the drum mounting bracket 42. The adjustment bracket 52 is locked into the position selected by the adjustment key 56, which in a preferred embodiment includes a threaded bolt which engages a lock nut secured to the drum mounting bracket 42. The adjustment key 56 is tightened down until the adjustment bracket 52 is secured in place between the adjustment key 56 and the drum mounting bracket 42, as illustrated in FIG. 2.

The adjustment mechanism 50 permits the selective positioning of the muting element 32 in relation to the outer surface of the drum head by applying greater or lesser force to maintain the muting element in operative engagement with the drum head. The muting element 32 may be positioned closer to the drum head by applying greater force, as illustrated in FIG. 5, wherein the muting element 32 is significantly compressed even while the drum head is not vibrating. This orientation of the muting element 32 provides a greater degree of muting effect when the drum is struck. Alternatively, the muting element 32 may be positioned such that it makes less contact with the drum head by applying less force and, therefore, it is minimally compressed while the drum head is not vibrating, as illustrated in FIG. 6. This orientation of the muting element 32 provides a lesser degree of muting effect when the drum is struck.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. To be mounted on a drum, a drum muting system comprising:

a) a muting assembly, said muting assembly including a muting element structured to alter a natural sound produced by the drum, b) an adjustment mechanism structured to adjust a muting effect of said muting assembly on the drum, c) a drum mounting structure disposed to cooperatively engage said muting assembly and said adjustment mechanism with the drum, d) a suspension assembly disposed in interconnecting relation between said outer frame and said inner muting assembly and structured to maintain said inner muting assembly in an operative position, e) said operative position at least partially defined by said muting element disposed in engaging relation with the drum head, and f) said suspension assembly being further structured to facilitate movement of said muting element with the drum head as the drum head vibrates.

2. A system as recited in claim 1 wherein said muting assembly further comprises an outer frame and an inner muting assembly supportably associated with said outer frame.

3. A system as recited in claim 2 wherein said muting element is cooperatively, associated with said inner muting assembly.

4. A system as recited in claim 3 wherein said muting element is connected to said inner muting assembly and extends outwardly therefrom into engaging relation with the drum head.

5. A system as recited in claim 1 wherein said suspension assembly is further structured and disposed to attenuate the movement of said inner muting assembly.

6. A system as recited in claim 5 wherein said suspension assembly comprises at least one biasing element disposed in interconnecting relation between said outer frame and said inner muting assembly.

7. A system as recited in claim 5 wherein said suspension assembly comprises a plurality of biasing elements disposed in spaced relation to one another and collectively disposed in an at least partially surrounding relation to said inner muting assembly.

8. To be mounded on a drum, a drum muting system comprising:

a) a muting assembly, said muting assembly including a muting element structured to alter a natural sound produced by the drum, b) an adjustment mechanism structured to adjust a muting effect of said muting assembly on the drum, c) a drum mounting structure disposed to cooperatively engage said muting assembly and said adjustment mechanism with the drum, d) said muting assembly further comprising an outer frame and an inner muting assembly supportably associated with said outer frame, and e) a muting element frame connected to said outer frame.

9. A system as recited in claim 8 wherein said muting element frame further comprises a support member interconnected to said muting element frame, said muting element mounted on said support member and extending outwardly therefrom into engaging relation with the drum head.

10. A system as recited in claim 9 wherein said support member is at least partially formed of a substantially rigid material.

11. A system as recited in claim 9 wherein said support member is at least partially formed of a substantially flexible material.

12. A system as recited in claim 10 further comprising a suspension assembly disposed in interconnecting relation between said outer frame and said muting element frame and structured to maintain said muting element in an operative position.

13. A system as recited in claim 12 wherein said operative position is further defined by said suspension assembly disposed and structured to facilitate and maintain said muting element into movable engagement with the drum head as the drum head vibrates.

14. To be mounted on a drum, a drum muting system comprising:

a) a muting assembly, said muting assembly including a muting element structured to alter a natural sound produced by the drum, b) an adjustment mechanism structured to adjust a muting effect of said muting assembly on the drum, c) a drum mounting structure disposed to cooperatively engage said muting assembly and said adjustment mechanism with the drum, d) said muting assembly further comprising an outer frame and an inner muting assembly supportably associated with said outer frame, and e) said adjustment mechanism connected to said outer frame, said outer frame connected in supporting relation to said inner muting assembly.

15. A system as recited in claim 14 wherein said adjustment mechanism is structured and disposed to adjustably position said outer frame relative to the drum head.

16. A system as recited in claim 15 wherein adjustable positioning of said outer frame relative to the drum head further adjusts the position of said muting element relative to the drum head.

17. A system as recited in claim 16 wherein the position of said outer frame relative to the drum head is determinative of a compression force of said muting element on the drum head.

18. A system as recited in claim 17 further comprising a suspension assembly disposed in interconnecting relation between said outer frame and said inner muting assembly.

19. A system as recited in claim 18 wherein the position of said inner muting assembly relative to said outer frame is determinative of a biasing force of said muting element on the drum head.

20. A system as recited in claim 19 wherein said adjustment mechanism further comprises an adjustment key allowing said outer frame to be secured in a selected position relative to the drum head.

21. A drum muting system mounted on a drum and comprising:

a) a muting assembly secured to an exterior of the drum, said muting assembly including an outer frame and an inner muting assembly supportably associated with said outer frame, b) said inner muting assembly including a muting element disposed in engaging relation to the drum head and structured to alter a natural sound produced by the drum, c) an adjustment mechanism disposed and structured to adjustably positon said muting element relative to the drum head and thereby adjust a muting effect of said muting assembly on the drum, d) said muting assembly further comprising a suspension assembly supportably and movably interconnecting said inner muting assembly to said outer frame, and e) said suspension assembly comprising a plurality of biasing elements.

22. A system as recited in claim 21 wherein said suspension assembly is structured to exert a biasing force on said inner muting assembly and said muting element connected thereto.

23. A system as recited in claim 22 wherein said inner muting assembly comprises a support member, said muting element secured to said support member and extending outwardly therefrom into engaging relation with the drum head.

24. A system as recited in claim 23 wherein said suspension assembly is structured and disposed to maintain said inner muting assembly and said muting element in operative engagement at least partially defined by biased engagement of said muting element with the drum head.

25. A system as recited in claim 21 wherein said suspension assembly is further disposed to attenuate the movement of said inner muting assembly thereby attenuating the movement of the drum head by operative engagement of said muting element with the drum head, said operative engagement being further defined by said muting element positioned and maintained in substantially direct contact with the outer surface of the drum head as the drum head vibrates.

26. A system as recited in claim 25 wherein said biasing elements comprise elastic bands.

27. A system as recited in claim 25 wherein said biasing elements comprise elastic chords.

28. A system as recited in claim 21 wherein said adjustment mechanism is structured and disposed to selectively position said muting element relative to the outer surface of the drum head to permit an increase or decrease in the muting effect.

29. A system as recited in claim 28 wherein said adjustment mechanism further comprises an adjustment key which allows said muting element to be at least temporarily secured in a selected position.

30. A system as recited in claim 21 wherein said muting element further comprises a muting portion and a base portion.

31. A system as recited in claim 30 wherein said muting portion comprises a highly resilient foam material.

32. A system as recited in claim 30 wherein said muting element further comprises at least one aperture between the surface which contacts the drum head and the opposing surface.

33. A drum muting system mounted to a drum comprising:

a) a muting assembly mounted on the drum and including an outer frame and an inner muting assembly cooperatively associated with a muting element, b) a suspension assembly disposed to maintain said inner muting assembly in an operative position relative to said outer frame, c) an adjustment mechanism disposed such that said muting element is selectively positionable relative to the outer surface of the drum head to permit an increase or decrease in the muting effect achieved, d) said muting element further comprising a muting portion and a base portion, e) said inner muting assembly further comprising a muting element frame and support member, f) said base portion being attached to said support member, said support member structured to maintain the interface between said support member and said base portion in a substantially planar orientation, and g) said suspension assembly further disposed to attenuate the movement of said inner muting assembly and the drum head by operative engagement of the muting element with the drum head, said operative engagement being defined by said muting element positioned and maintained in substantially direct contact with the outer surface of the drum head as it vibrates thereby essentially tracking the vibration of the drum head and at least partially absorbing the vibration from the drum head when the drum head is struck.

34. A system as recited in claim 33 wherein said plurality of biasing elements comprise elastic bands.

35. A system as recited in claims 33 wherein said plurality of biasing elements comprise elastomeric chords.

36. A system as recited in claim 33 wherein said muting portion is substantially comprised of a highly resilient foam rubber.

37. A system as recited in claim 33 wherein said muting portion is substantially comprised of a felt like material.

38. A system as recited in claim 33 wherein said muting element comprises at least one aperture between the surface which contacts the drum head and the opposing surface.

39. A system as recited in claim 33 wherein said base portion substantially comprises flexible plastic.

40. A system as recited in claim 33 wherein said base portion substantially comprises rigid plastic.

41. A system as recited in claim 33 wherein said support member substantially covers at least one surface of said muting element.

42. A system as recited in claim 33 wherein said support member substantially covers at least one of the major surfaces defined by said muting element frame.

43. A system as recited in claim 33 wherein said outer frame at least partially encircles said inner muting assembly.

44. A system as recited in claim 33 wherein said outer frame substantially encircles said inner mounting assembly.

45. A system as in claim 33 wherein said suspension assembly further comprises a plurality of biasing elements each attached to one of a plurality of corresponding pairs of biasing element anchors, wherein each of said corresponding pairs of biasing element anchors includes a first anchor and a second anchor each secured to a different one of said outer frame and said inner muting assembly.

* * * * *